United States Patent [19]

Pawlikowski et al.

[11] 4,050,080

[45] Sept. 20, 1977

[54] CRT SCREEN EXPOSURE DEVICE UTILIZING IMPROVED LIGHT MEANS

[75] Inventors: Stanley Leonard Pawlikowski, Seneca Falls; Carl William Penird, Waterloo, both of N.Y.

[73] Assignee: GTE Sylvania Incorporated, Stamford, Conn.

[21] Appl. No.: 672,968

[22] Filed: Apr. 2, 1976

[51] Int. Cl.[2] ..... G03C 5/00

[52] U.S. Cl. ..... 354/1; 96/36.1

[58] Field of Search ..... 354/1; 96/36.1

[56] References Cited

U.S. PATENT DOCUMENTS

| | | | |
|---|---|---|---|
| 3,954,470 | 5/1976 | Barczynski et al. | 354/1 |
| 4,001,018 | 1/1977 | Tsuneta et al. | 354/1 |

*Primary Examiner*—L. T. Hix
*Assistant Examiner*—Alan Mathews
*Attorney, Agent, or Firm*—Norman J. O'Malley; Frederick H. Rinn; Robert T. Orner

[57] ABSTRACT

An improvement is provided in a cathode ray tube screen exposure device wherein both the intensity and the shaping of the exposure radiation is improved by employing two conjunctive sources of radiant energy. The alpha source is positioned in a substantially superjacent manner relative to a related beta source on a substantially common optical axis. Each source is separately adjustable in a limited arcual manner, during operation of the device, to achieve optimized light output in the form of a conjunctive source of radiant energy of optimized shaping.

3 Claims, 2 Drawing Figures

CRT SCREEN EXPOSURE DEVICE UTILIZING IMPROVED LIGHT MEANS

BACKGROUND OF THE INVENTION

This invention relates to a cathode ray tube screen exposure device and more particularly to radiant energy source means employed in the optical system of a cathode ray tube screen exposure device.

Cathode ray tubes of the type employed in image reproduction, such as in color television applications and similar display media, conventionally utilize electron gun structures which provide one or more electron beams to effect the desired display imagery. In operation, the modulated electron beams are predeterminately scanned across the screen of the tube to provide electron impingement upon selected color-emitting phosphor configurations comprising the patterned screen disposed on the viewing panel of the tube, whereupon the transmitted color display is reproduced. Color picture tubes of this type usually employ a multi-apertured grid, mask, or other type of negative structure which is interposed between the electron gun assembly and the screen structure to provide either masking of the screen, or deflection or focusing of the electron beam or beams thereat.

In a conventional color cathode ray tube, the electron sensitive screen is usually comprised of a repetitive pattern of multitudinous dot, bar, or stripe formations of various phosphors capable of emitting, for example, green, red and blue color luminescence upon electron beam impingement. In certain tube constructions, the pattern of phosphors comprising the screen is disposed to overlay an array of multitudinous window areas of an opaque screen matrix formed on the viewing portion of the panel. The shapings or configurations of the matrix windows and the associated color phosphor patterns constituting this type of screen structure are formed in accordance with the number of electron beams utilized and with the discrete aperture configurations and operative characteristics of the grid or mask structure employed in the respective tube.

Since a vast number of color phosphor groups are required to produce a high resolution display of desired color purity, the process employed in forming both the basic window matrix, and the associated phosphor screen, must be one that is capable of accurately forming a multitude of similar discrete configurations in the screen arrangement. In a preferred method for fabricating the screen structure for a color tube, a photoprinting technique is utilized wherein the viewing panel of the tube, having an interior coating of a photosensitive resist composition disposed thereon, is positioned upon a screen exposure device and suitably photo-exposed through the related negative or multi-apertured mask by radiant energy emanating from a specifically oriented light source means within the device. Subsequent development of the numerous selectively exposed areas of the panel, produces either a first window pattern of the matrix, or in proper sequence, the associated first color phosphor pattern of the subsequently formed screen. Such photo exposure is sequentially repeated in the proper steps of the procedure to form the remaining windows in the matrix and likewise to later effect deposition of the respective color-emitting phoshpor materials associated therewith to complete the fabrication of the patterned screen construction. In separately producing the matrix and the related patterned array of phosphor elements associated therewith, the light means providing the radiant energy necessary for the photodeposition procedure, is appropriately offset from the central axis of the device during the exposure procedure for some or all of the respective exposure steps in accordance with the requirements for each of the color phosphor patterns and definitive window areas constituting the screen. For example, in forming a tri-dot screen structure a light source means is offset for each of the respective exposure operations; while in forming tri-color inline type screens, the light source means is offset from a central axis for only two of the exposure operations.

The screen exposure device, which is conventionally known in the art as a "lighthouse" usually contains an optical system comprising a light permeable refractive medium or corrective lens and an associated light source means positioned to provide the required amount of radiant or actinic energy for proper photo-exposure activation of the light sensitive coating disposed on the viewing area of the panel. For instance, to produce a desired screen pattern of both the basic matrix and the related phosphor elements of the screen structure, the components of the optical system are oriented or aligned relative to an optical axis in a manner to radiate light over the whole of the multi-apertured mask. Thus, the actinic energy traverses the apertures therein to expose discretely shaped areas, be they matrix windows or the subsequently disposed phosphor dots or stripes, on the respective sensitized screen material therebehind to thereby produce a patterned array of defined configurations having exactness in accordance with the registration requirements of the subsequent electron beam impingement in the finished tube.

A factor of prime importance in the optical system of the exposure device, is the source means of radiant energy employed therein. One common source of exposure radiation has been a mercury vapor lamp evidencing an incandescent arc of substantially elliposidal or elongated shaping. The luminescence of this arc in conjunction with the reflective means provides the sole source of radiant energy for the photo-exposure process. Consequently, to polymerize the photosensitive material with a given amount of exposure radiation, the intensity of the irradiation determines the time factor of the exposure and thereby becomes an important consideration in establishing the speed of the operation. In addition, non-uniformity of light distribution, due to changes in the shape of the incandescent arc, has been noticed during the operational life of the lamp. Accordingly, optimized exposure radiation emanating from the optical system, to provide desired uniformity of exposure, is often unattained due to the difficulty encountered in effecting minute adjustments of the exposure lamp during operation of the device. Thus, the regulation and monitoring of radiant energy output becomes a major problem in the exposure operation.

OBJECTS AND SUMMARY OF THE INVENTION

It is an object of the invention to reduce and obviate the aforementioned disadvantages evidenced in the prior art. A further object of the invention is the provision of an improved radiant energy source means within the exposure device to provide an increase in the radiant energy output over that evidenced in the prior art. Another object of the invention is the provision of a screen exposure device having radiant energy source means that is adjustable to provide a source of radiant energy evidencing an optimized incandescent shaping. An additional object is the provision of radiant energy source means wherein the shape of the incandescent output is adjustable during operation of the device.

These and other objects and advantages are achieved in one aspect of the invention wherein there is provided an improvement in both the intensity and the shaping of the radiant energy source means oriented relative to the light output area of the optical system in the cathode ray tube screen exposure device. The improvement relates to the optical system therein and particularly to the radiant energy source means which constitutes a prime part thereof. The improvement embodies the positioning of an alpha light means in a plane spatially and proximally related to the light output area of the system in a manner substantially normal to the axis of the optical system. This effects substantially centered orientation of the alpha source of radiant energy on the optical axis. The alpha-light means is supported in a manner to effect arcual movement in a limited and finely adjustable manner about the optical axis to optimize positioning of the alpha incandescent arc emanating therefrom. A beta light means is provided in a plane spatially related to and parallel with the plane of the alpha light means to likewise effect substantially centered orientation of the beta source of radiant energy on the optical axis. Consequently, the beta light means is superjacently positioned in substantially crossed or angular relationship with the alpha light means and similarly supported in a manner to be arcually movable in a limited and finely adjustable manner about the optical axis to optimize positioning of the beta incandescent arc. Since both the alpha and beta light means are individually arcually adjustable, there is provided an optimized conjunctive output of radiant energy of increased brightness, and one wherein the individual light outputs are positionally adjustable relative to a common axis to provide a conjunctive incandescent irradiative source of optimized shaping. Associated with the alpha and beta sources of radiant energy is a reflective means having a substantially concave surface fashioned to provide an optimized conjuncture of reflective energy which is directed toward the light output area of the optical system.

DESCRIPTION OF THE PREFERRED EMBODIMENT

For a better understanding of the present invention, together with other and further objects, advantages and capabilities thereof, reference is made to the following specification and appended claims in connection with the aforedescribed drawings.

It is to be understood that the radiant energy source means of the invention is equally applicable to utilization in screen exposure devices for fabricating tri-dot, striped, or lined color cathode ray tube screen pattern arrays and associated window matrices.

Figure 1:
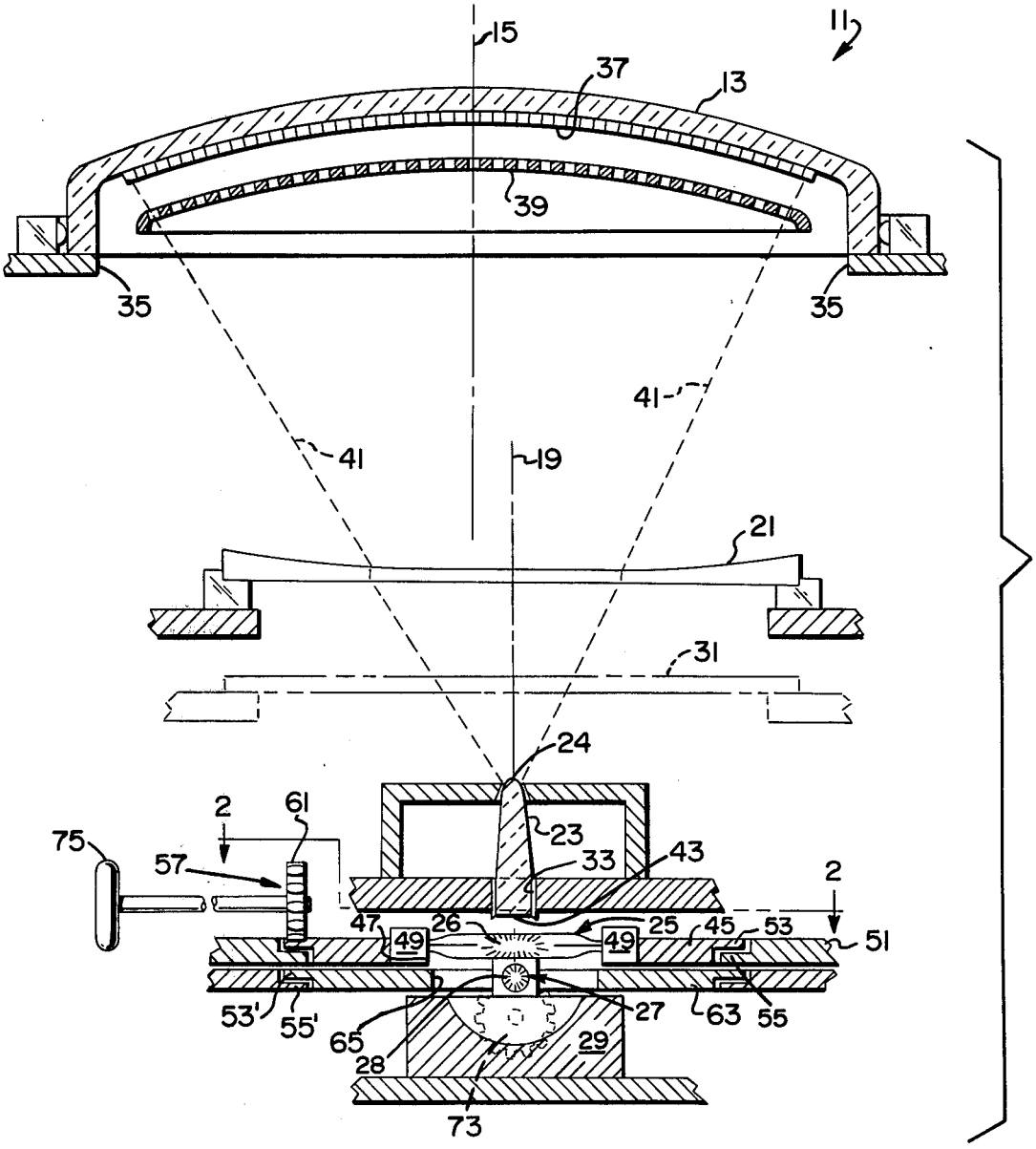
FIG. 1 is a cross-sectional view showing the rudiments of a cathode ray tube screen exposure device taken substantially along the line 1—1 of FIG. 2 wherein the improved means of the invention are incorporated.

With reference to the drawings, there is shown in FIG. 1 the rudiment portions of a cathode ray tube screen exposure device 11 or lighthouse structure of the basic type employed in forming patterned color cathode ray tube screens. The exposure device has an opening therein shaped to accommodate the placement and exposure of a cathode ray tube face or display panel 13. The device has a central axis 15 therethrough and employs an internally positioned optical system 17 oriented on an optical axis 19 which may be offset from the central axis 15. As shown, the exemplary optical system is positioned to expose one of the respective screen or matrix patterns, and includes a refractive medium or lens 21, a light collector rod 23, radiant energy source means 25 and 27, and an associated reflective element 29.

If desired, the system may include a light attenuating element or graded filter means 31 to selectively modify the exposure radiation. In some systems, a configuration of a thin coating gradient of light attenuating material is discretely disposed on a surface of the refractive medium 21. Also, in certain optical systems, the light collector rod 23 and enclosure 22 are omitted and a defined aperture, such as denoted by 33, substituted therefor. In this disclosure, the terminology "light output area" is intended to delineate sufficient breadth to include either a light collector rod or a defined optical aperture through which light is beamed.

Suitably positioned over the opening 35 in the screen exposure device 11 is a cathode ray tube display panel 13 having a photoresist composition disposed on the inner surface thereof to form a light sensitive screen 37. The shape or perimetric contour of the panel may be round, oval, rectangular, or any combination or variation thereof. Whatever perimetric contour the panel may have, the dimensional geometry of the opening in the exposure device is made commensurate therewith. Oriented within the panel 13, and spaced from the screen is a negative or multi-apertured mask 39 through which exposure radiation 41 is beamed to form a discretely patterned array of apertured shapings on the light sensitive screen therebeneath.

In greater detail, the figures illustrate the several componental parts contained within the exemplary exposure optical system 17. The light output area which, in this instance, is a tip 24 of a diffusely ground quartz rod 23 whereat the sole light exit area is of a shape in keeping with the screen forming requirements from which exposure radiation is beamed through the refractive medium 21 toward the panel. The input or base surface 43 of the rod collects radiant energy emitted from the improved source means 25 and 27 of the invention.

Positioned proximal to the input surface of a collector rod is an alpha light means 25, such as a small cylindrical mercury vapor lamp which provides an alpha source of radiant energy in the form of a luminescent alpha arc 26. The alphalight means 25 is positioned in a plane spatially and proximally related to the plane of the light output area and substantially normal to the optical axis 19 to effect substantially centered orientation of the alpha source of radiant energy 26 on the optical axis. The alpha light means or lamp 25 is positionally accommodated on alpha support means 45 to permit arcual movement in a limited and finely adjustable manner about the optical axis. The alpha support means may be in the form of a substantially circular plate, having a substantially central or annular opening 47 therein peripherally flanked by diametrically oriented socket means 49 wherein the alpha lamp 25 is positioned in a manner to bridge the opening. For purposes of clarity, the electrical leads to the socket means are eliminated. The alpha support means 45 is at last partially rotatable relative to a receptively formed stationary support 51 in the device. For example, the alpha support means has a peripheral flange 53 which compatibly rests within a groove 55 formed in the stationary ledge 51 to provide a bearing and sliding surface therebetween. Arcual movement of the alpha support means 45 is achieved by mechanical means 57 such as a rack 59 and knob-activated pinion 61 arrangement having a conventional locking means, not shown, to maintain adjusted positioning of the alpha source of radiant energy 26.

A beta light means or lamp 27, providing a beta arc source of radiant energy 28, is positioned in a plane spatially related to and parallel with the plane of the alpha light means 25 in a manner to effect substantially centered orientation of the beta source of radiant energy 28 on the optical axis 19. As shown, the beta light means 25 is superjacently positioned in a substantially crossed or angularly adjustable relationship with the alpha light means 27, and is located on a beta support means 63, such as a substantially circular plate, which is positioned to be closely adjacent and parallel with the alpha support means 45 previously described. The beta support means, which may be movably supported by a flange 53' and ledge 55' arrangement, has a substantially central or annular opening 65 therein across which the beta light means or lamp 27 is diametrically oriented by socket means 67. The central opening 47 in the alpha support means 45 is substantially diametrically modified with exemplary cut-out portions 69 to accommodate arcual movement of the beta socket means 67. The beta support means is movable in an arcual manner similar to that of the alpha support means 45, such being effected for example, by a rack 71 and knob-actuated pinion 73 arrangement of the type previously described. In this manner, the beta light means 27 is arcually movable in a limited and finely adjustable manner about the optical axis 19.

Figure 2:
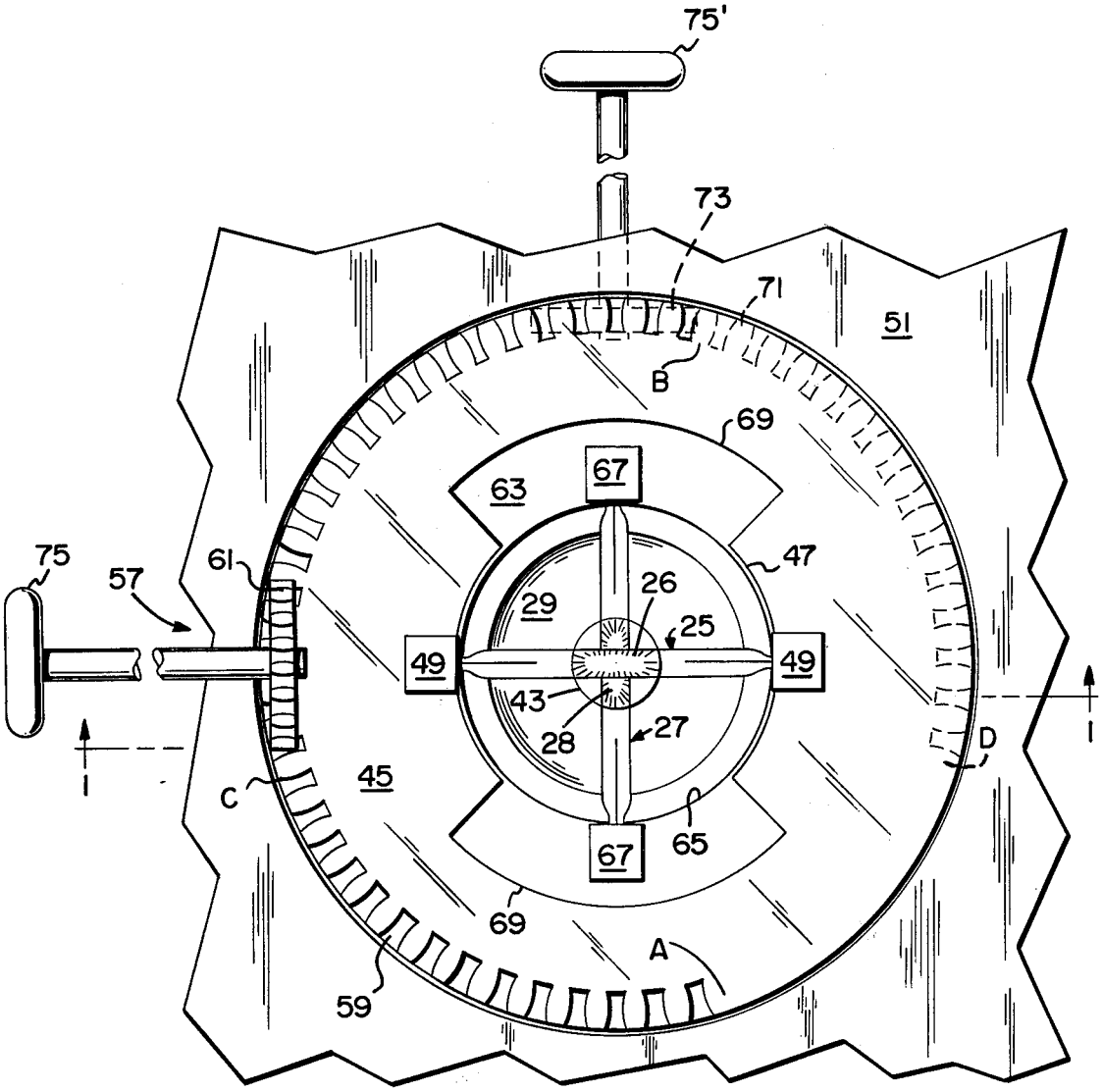
FIG. 2 is an enlarged plan view of a portion of the device taken substantially along the line 2—2 of FIG. 1 wherein the invention is further illustrated.

As shown and described, the alpha 25 and beta 27 light means are substantially in angular relationship with one another, each being individually and independently arcually movable by exteriorly activated mechanical means such as respective knobs 75 and 75'. As illustrated, particularly in FIG. 2, the exemplary rack 59 associated with a portion of the periphery of the alpha support means 45 extends in a clockwise manner from substantially 5:30 (A) to 12:30 (B) therearound. In conjunction therewith, the exemplary rack on the lower surface of the beta support means 63 extends in a clockwise manner from substantially 8:30 (C) to 3:30 (D) therearound. By such geared arrangements the individual alpha and beta radiant energy sources 26 and 28, emanating from the respective alpha and beta lamps 25 and 27, may be adjusted from substantially superposed positioning through substantially ninety-degree crossed angular relationship with one another. Accordingly, this versatile arrangement additionally facilitates the achievement of a substantially linearized source of radiant energy, if such be desired.

The reflective means 29, associated with the alpha and beta radiant energy sources, has a concave surface fashioned to provide an optimized conjuncture of reflected energy which is efficiently directed toward the light output area, in this instance, the input surface 43 of the light collector rod.

Thus, the invention provides improved radiant energy source means which provides increased radiant energy output over that evidenced in the prior art, thereby markedly reducing the time factor of the exposure operation for efficiently fabricating both the windowed matrix and the phosphor patterns of the screen structure. The plural sources are positionally adjustable to provide a conjunctive source of optimized incandescent shaping that is facilely adjustable during operational set-up of the device and affords accurate control of the light gradient across the screen. The increased and optimized exposure illumination provided by the invention promotes improved screen pattern definition by permitting the usage of smaller apertures in the mask member.

While there has been shown and described that are at present considered the preferred embodiments of the invention, it will be obvious to those skilled in the art that various changes and modifications may be made therein without departing from the scope of the invention as defined by the appended claims.

What is claimed is:

1. An improvement in a cathode ray tube screen exposure device having an axis therethrough wherein an internally positioned optical system is employed to selectively photo-expose a patterned screen structure on a CRT viewing panel having a sensitized coating disposed thereon in spatial relation to a multi-apertured grid oriented thereover, said optical system having an axis and including a defined light output area, related source means of radiant energy and associated reflective means, said improvement relating to said optical system and particularly to the radiant energy source means incorporated therein comprising:

alpha light means providing a substantially concentrated alpha source of radiant energy in the form of a substantially ellipsoidal incandescence positioned in a plane spatially and proximally related to the plane of said light output area and substantially normal to said optical axis to effect substantially centered orientation of said alpha source of radiant energy on said optical axis, said alpha light means being supported to be arcually movable in a limited and finely adjustable manner about said optical axis;

beta light means providing a substantially concentrated beta source of radiant energy in the form of a second substantially ellipsoidal incandescence positioned in a plane spatially related to and parallel with the plane of said alpha light means to effect substantially centered orientation of said beta source of radiant energy on said optical axis, said beta light means being superjacently positioned on said axis in substantially angularly crossed relationship with said alpha light means and supported to be arcually movable in a limited and finely adjustable manner about said optical axis, said alpha and beta light means being arcually adjusted to provide an optimized conjunctive output of radiant energy substantially along said axis; and a reflective means associated with said alpha and beta sources of radiant energy, said reflective means having a substantially concave surface fashioned to provide an optimized conjuncture of reflected energy directed toward said light output area.

2. The improvement in the optical system of the cathode ray tube screen exposure device according to claim 1 wherein said defined light output area is the light emitting portion of a light collector rod, said rod having an input area proximal to said alpha source of radiant energy.

3. The improvement in the optical system of the cathode ray tube screen exposure device according to claim 1 wherein said alpha and beta light means may be adjusted from substantially superposed positioning through substantially ninety-degree crossed relationship with one another.

* * * * *